US008235248B2

(12) United States Patent
Kim

(10) Patent No.: US 8,235,248 B2
(45) Date of Patent: Aug. 7, 2012

(54) AUTOMATIC TABLET PACKING APPARATUS HAVING SLIDING RACK

(75) Inventor: Jun-Ho Kim, Suseong-gu (KR)

(73) Assignee: JVM Co., Ltd., Daegu (KR)

( * ) Notice: Subject to any disclaimer, the term of this patent is extended or adjusted under 35 U.S.C. 154(b) by 601 days.

(21) Appl. No.: 12/421,164

(22) Filed: Apr. 9, 2009

(65) Prior Publication Data

US 2009/0266029 A1 Oct. 29, 2009

(30) Foreign Application Priority Data

Apr. 24, 2008 (KR) ..... 10-2008-0038304
Dec. 4, 2008 (KR) ..... 10-2008-0122405

(51) Int. Cl.
*B65D 83/00* (2006.01)
*B65B 1/04* (2006.01)
*B65B 3/04* (2006.01)

(52) U.S. Cl. ..... 221/65; 221/131; 221/64; 221/24; 221/242; 221/279; 221/280; 221/2; 221/3; 221/4; 221/6; 221/17; 221/124; 221/130; 221/133; 221/19; 221/92; 221/171; 221/173; 53/235; 53/473; 209/551; 700/231

(58) Field of Classification Search ..... 221/92, 221/171, 173, 131, 65, 64, 241, 242, 279, 221/280, 2, 3, 4, 6, 17, 124, 130, 133, 19, 221/5; 53/235, 473; 209/551; 700/231
See application file for complete search history.

(56) References Cited

U.S. PATENT DOCUMENTS

| | | | | |
|---|---|---|---|---|
| 5,651,476 | A * | 7/1997 | Percy et al. | 221/131 |
| 7,747,345 | B2 * | 6/2010 | Ohmura et al. | 700/231 |
| 7,861,492 | B2 * | 1/2011 | Yuyama et al. | 53/53 |
| 2005/0234591 | A1 * | 10/2005 | Kim | 700/231 |
| 2007/0150092 | A1 * | 6/2007 | Ohmura et al. | 700/231 |

FOREIGN PATENT DOCUMENTS

| | | | |
|---|---|---|---|
| JP | 2002264902 | A | 9/2002 |
| JP | 2003237702 | A | 8/2003 |
| JP | 2004284680 | A | 10/2004 |

* cited by examiner

*Primary Examiner* — Gene O. Crawforfd
*Assistant Examiner* — Rakesh Kumar
(74) *Attorney, Agent, or Firm* — Kile Park Goekjian Reed & McManus PLLC

(57) ABSTRACT

Disclosed is an automatic tablet packing apparatus having sliding racks, wherein tablets received in a plurality of tablet cassettes are successively packed on a per dose basis based on a medical prescription. Each of the sliding racks includes a pair of left and right partition walls, a tablet discharge passage to guide the tablets discharged from the tablet cassettes being defined by facing inner surfaces of the left and right partition walls. Cassette pedestals are attached to outer surfaces of the left and right partition walls and in turn, the tablet cassettes are detachably arranged on the cassette pedestals. The left and right partition walls are able to be individually pulled out from a body of the apparatus. As the left or right partition wall is pulled out, the tablet discharge passage is revealed to the outside thus enabling easy cleaning thereof.

5 Claims, 13 Drawing Sheets

AUTOMATIC TABLET PACKING APPARATUS HAVING SLIDING RACK

BACKGROUND OF THE INVENTION

1. Field of the Invention

The present invention relates to an automatic tablet packing apparatus, wherein a desired one of tablets received in a plurality of tablet cassettes is automatically discharged and packed on a per dose basis based on a medical prescription. More particularly, the present invention relates to an automatic tablet packing apparatus having sliding racks, wherein a tablet discharge structure, arranged in an upper region of the automatic tablet packing apparatus, is constructed by sliding racks each including left and right partition walls, a tablet discharge passage being defined between the left and right partition walls, whereby the table discharge passage between the respective neighboring partition walls is revealed to the outside when the left partition wall or the right partition wall of each sliding rack is individually pulled out, thus enabling easy cleaning of the tablet discharge passage.

2. Description of the Related Art

FIGS. 1 to 3 are, respectively, a front view, a side view and a plan view schematically illustrating a conventional automatic tablet packing apparatus having sliding racks as disclosed in Korean Patent Registration No. 10-0498727 and Korean Utility Model Registration No. 20-0274355. The conventional automatic tablet packing apparatus includes a body 1, and a tablet arrangement structure arranged in an upper region of the body 1, the table arrangement structure being configured such that a plurality of tablet cassettes C configured to receive tablets is mounted on cassette pedestals. In addition, provided in a lower region of the body 1 are hoppers 41, 43 and 45 to collect the tablets discharged and dropped from the tablet cassettes C, a printer 34 to print a variety of information on a surface of tablet packing paper, and a packing device 30 to pack the collected tablets, having passed through the hoppers 41, 43 and 45, by use of the packing paper.

The tablet arrangement structure arranged in the upper region of the body 1 include sliding racks 10, and door mounts 20 connected to the body 1 by means of hinges 20*a*, the cassette pedestals and tablet cassettes C stacked in multiple layers being mounted to the sliding racks 10 and door mounts 20. In the conventional automatic tablet packing apparatus, an upper frame of the body 1 is provided with upper and lower guide rails and thus, the sliding racks 10 are able to slide forward and rearward along the guide rails. The cassette pedestals are attached to left and right partition walls of each sliding rack 10, and in turn, the tablet cassettes C are stacked one above another on the cassette pedestals. These cassette pedestals and tablet cassettes C must be separable for cleaning of a tablet discharge passage 11.

The tablet discharge passage 11 is defined between the left and right partition walls of each sliding rack 10. The left and right partition walls are kept at fixed positions by means of couplers (not shown) provided inside the partition walls.

In the above-described conventional automatic tablet packing apparatus, when it is necessary to clean the tablet discharge passage 11 of the sliding rack 10, the sliding rack 10 is first pulled out as shown in FIG. 3 and then, all the cassette pedestals and the tablet cassettes C mounted to the sliding rack 10 are separated from the sliding rack 10. Thereafter, the partition walls defining the tablet discharge passage 11 are separated from the sliding rack 10 so as to be subjected to cleaning. This is very laborious and time-consuming work.

SUMMARY OF THE INVENTION

Therefore, the present invention has been made in view of the above problems, and it is an object of the present invention to provide an automatic tablet packing apparatus having sliding racks, wherein left and right partition walls of each of the sliding racks are separated from each other so as to be individually pulled out, outer surfaces of the partition walls being provided with cassette pedestals and tablet cassettes and facing inner surfaces of the partition walls defining a tablet discharge passage, whereby the tablet discharge passage is able to be revealed to the outside when the left partition wall or the right partition wall is individually pulled out, thus enabling easy cleaning of the tablet discharge passage.

In accordance with an aspect of the present invention, the above and other objects can be accomplished by the provision of an automatic tablet packing apparatus having a sliding rack to be pulled out along upper and lower guide rails provided at an upper frame of a body, wherein the sliding rack includes a pair of left and right partition walls, a tablet discharge passage being defined between the pair of partition walls, wherein cassette pedestals are attached to outer surfaces of the left and right partition walls, and tablet cassettes are detachably arranged on the cassette pedestals, wherein the left and right partition walls are perforated with partition discharge holes in communication with tablet discharge holes of the tablet cassettes, and wherein the left and right partition walls are separated from each other and are slidable individually along the guide rails.

A plurality of frame guides may be provided at the outer surfaces of the left and right partition walls in a transversal direction, a cassette frame may be slidably coupled to each frame guide in a transversal direction, and a plurality of the cassette pedestals may be attached to the cassette frame, and the tablet cassettes are mounted on the cassette pedestals.

The cassette frame may have frame discharge holes in communication with the tablet discharge holes of the tablet cassettes, and the frame discharge holes may also be in communication with the partition discharge holes.

The cassette frame may be caught by a grip tool provided at a rear side of the body, to prevent the cassette frame from being pulled out together with the left or right partition wall when the left or right partition wall is pulled out.

Guide members may be fixedly mounted, respectively, to the inner surfaces of the left and right partition walls. Each of the guide members may have through-holes in communication with the partition discharge holes. The through-holes may be aligned in a longitudinal direction of the guide member, and guide portions protruding from the guide member may extend longitudinally at left and right sides of the through-holes. A U-shaped channel member may be fitted between the neighboring guide portions, and the channel member may have discharge holes in communication with the through-holes.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE INVENTION

Figure 1:
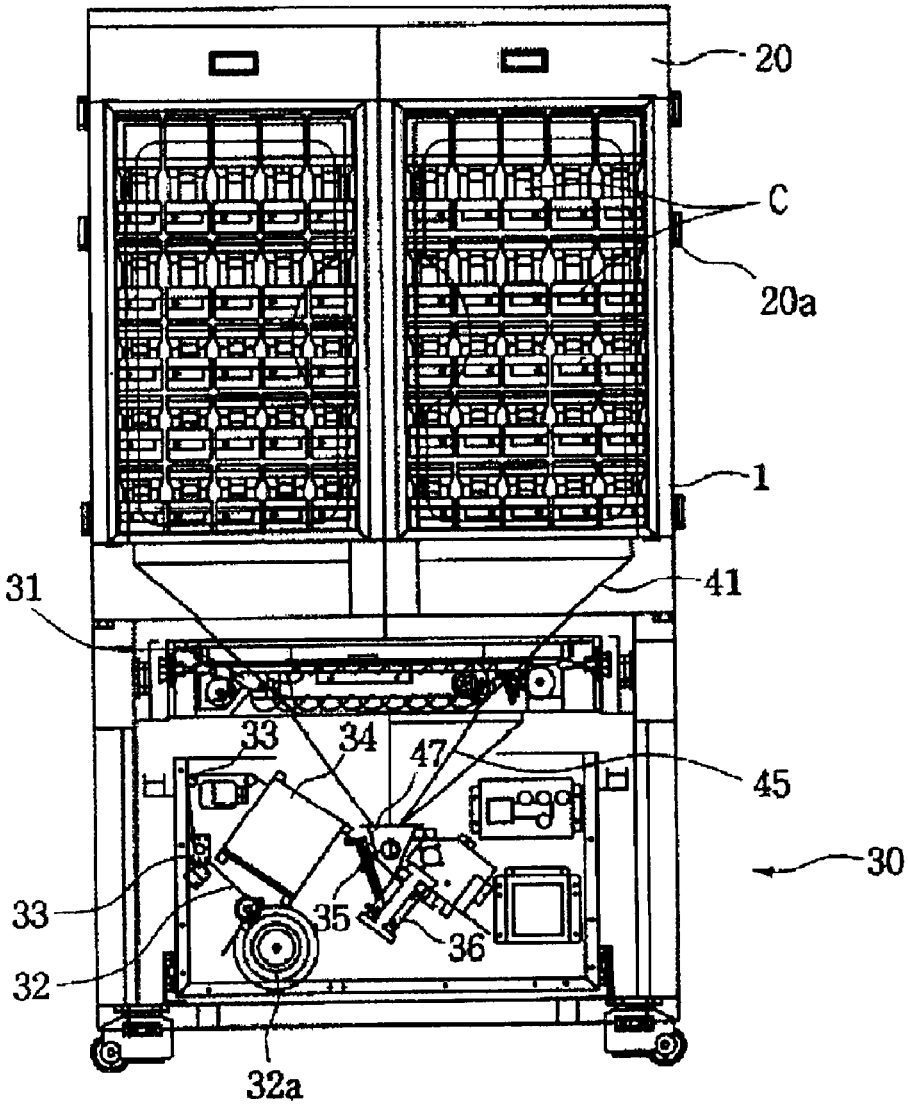
Fig.1 Prior Art
FIGS. 1 to 3 are, respectively, a front view, a side view and a plan view schematically illustrating a conventional automatic tablet packing apparatus.
Figure 2:
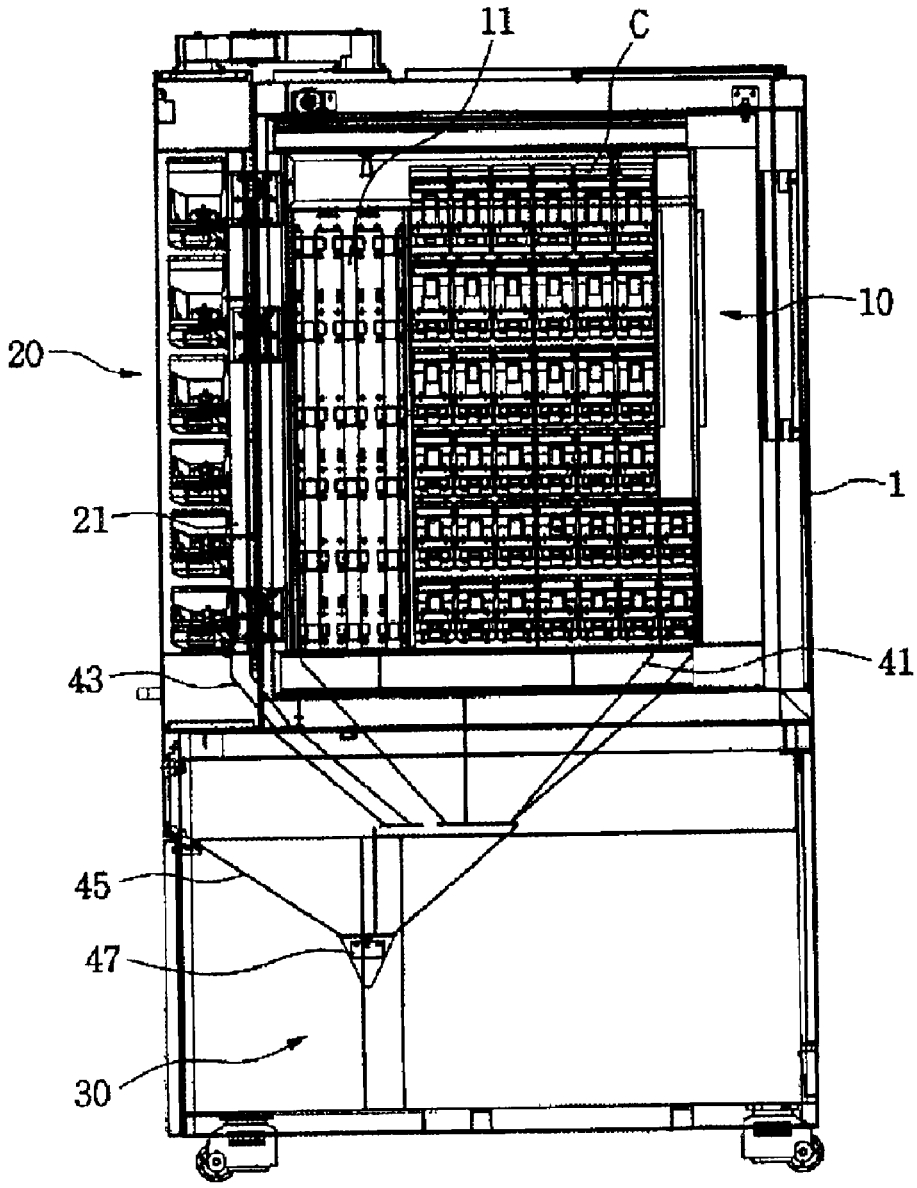
Fig.2 Prior Art
Figure 3:
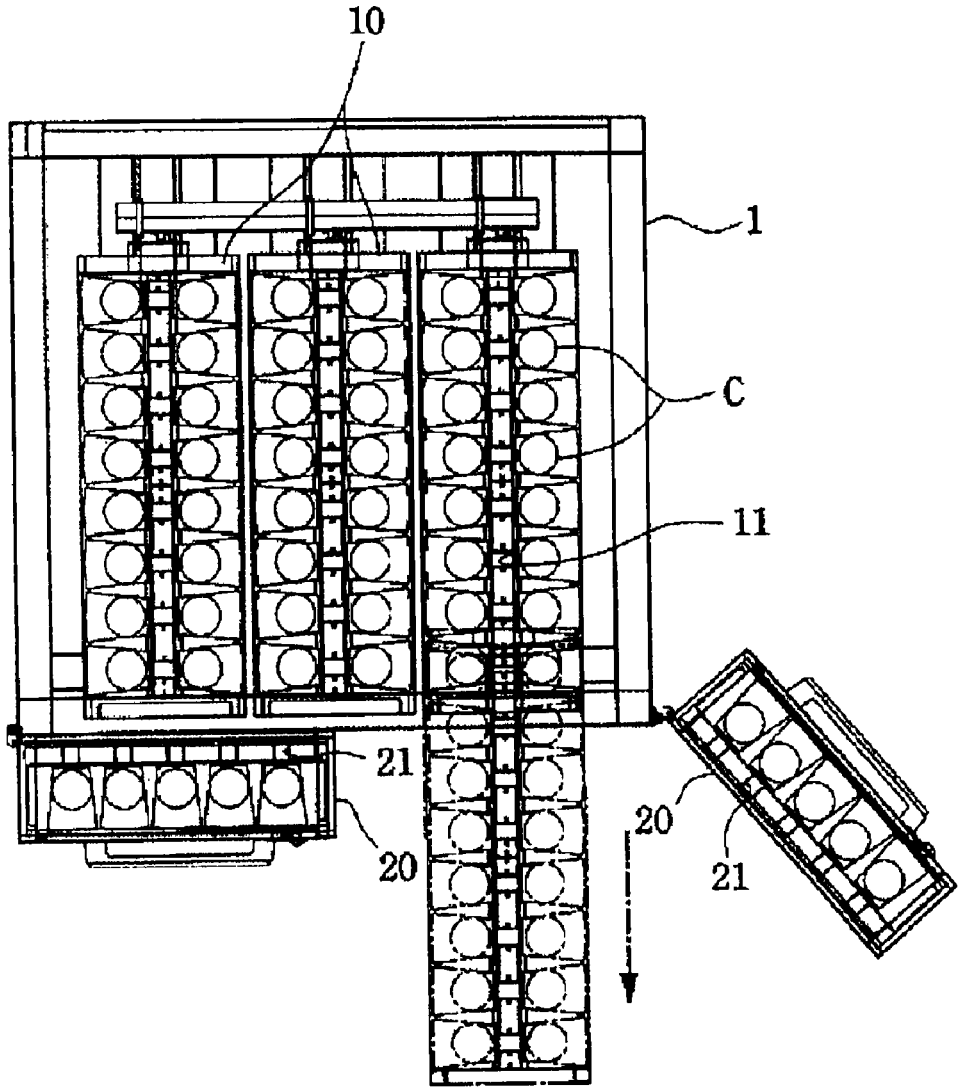
Fig.3 Prior Art
Figure 4A:
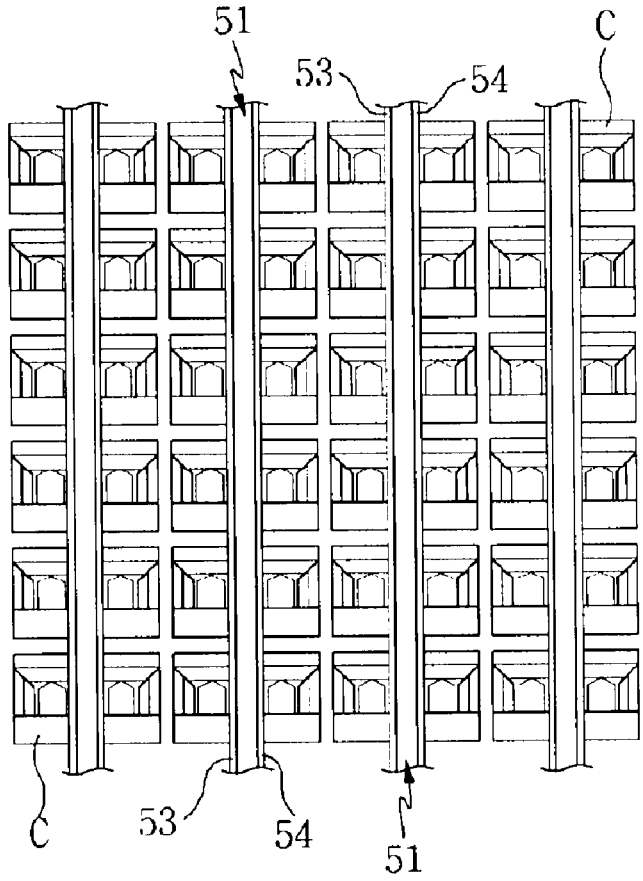
FIGS. 4A and 4B are, respectively, a front view and a plan view illustrating arrangement of tablet cassettes provided in an automatic tablet packing apparatus according to an embodiment of the present invention.
Figure 4B:
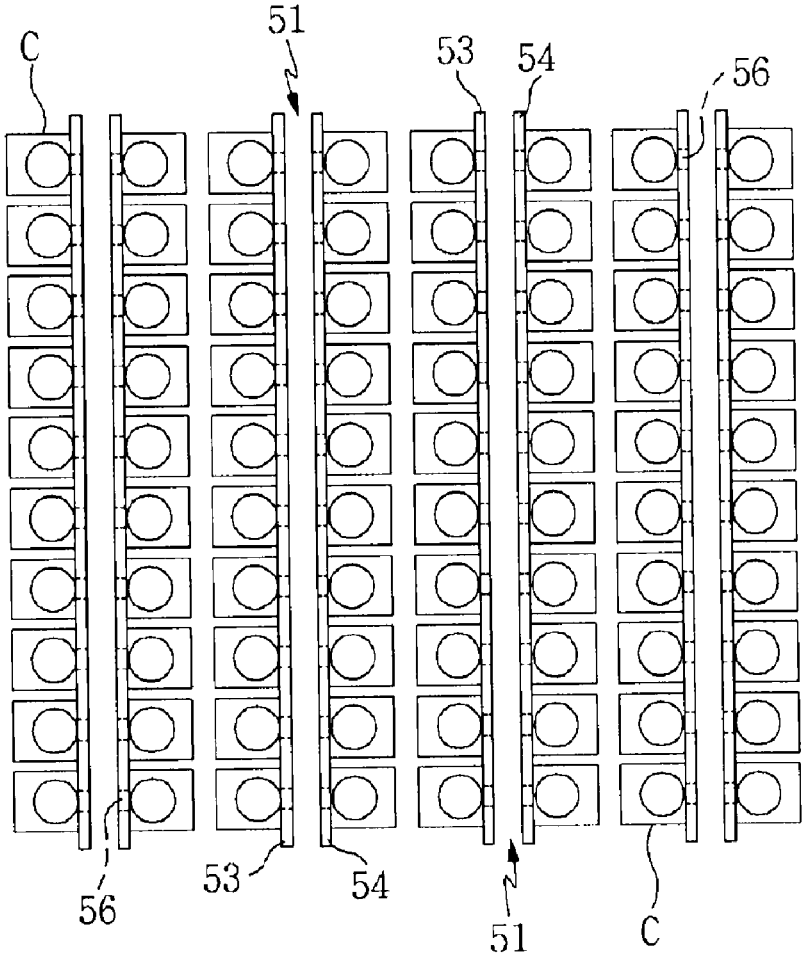
Figure 5A:
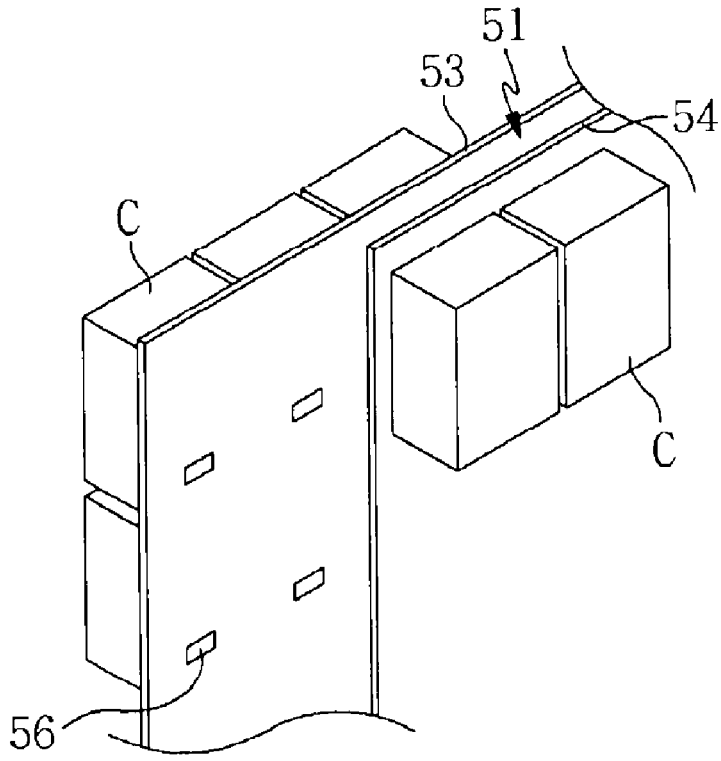
FIGS. 5A and 5B are, respectively, a perspective view and a plan view illustrating a state wherein some of tablet cassettes are pulled out from the automatic tablet packing apparatus according to the embodiment of the present invention.
Figure 5B:
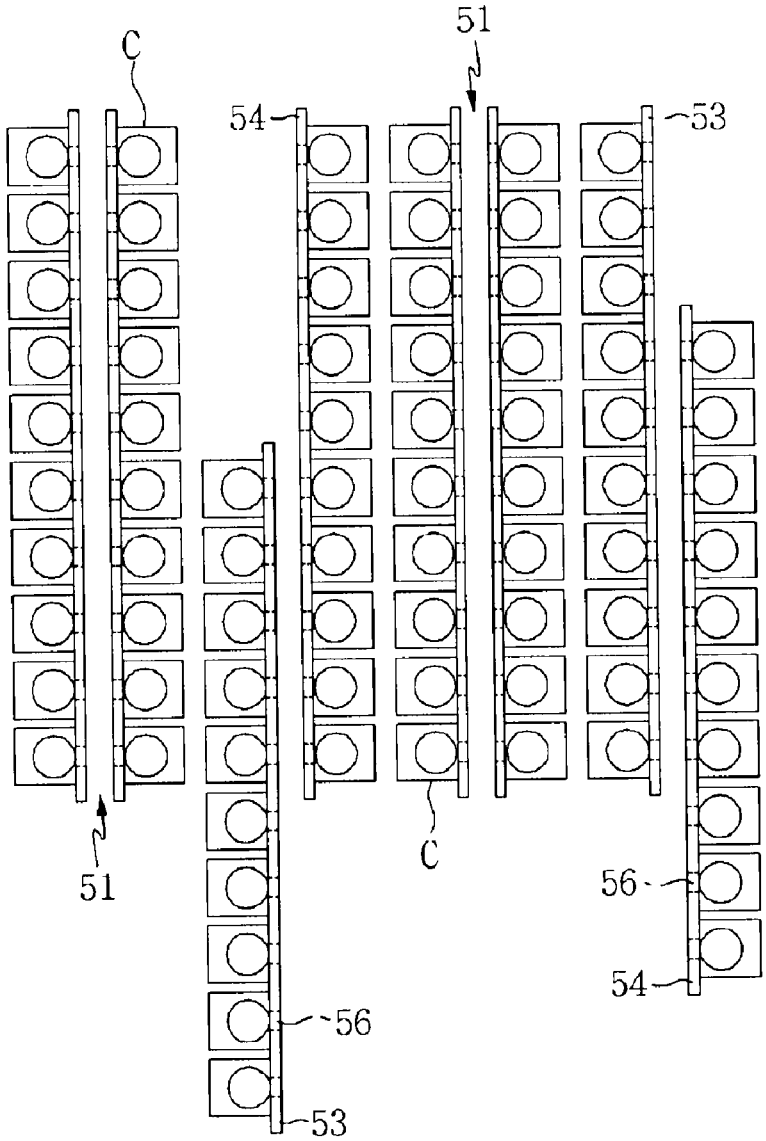

Hereinafter, an automatic tablet packing apparatus according to exemplary embodiments of the present invention will be described in detail with reference to the accompanying drawings. FIGS. 4A and 4B illustrate arrangement of cassette pedestals and tablet cassettes C of sliding racks provided in the automatic tablet packing apparatus according to an embodiment of the present invention, FIG. 4B being a front view and FIG. 4B being a plan view. FIGS. 5A and 5B illustrate a pulled-out state of the sliding racks provided in the automatic tablet packing apparatus according to the embodiment of the present invention, FIG. 5B being a perspective view and FIG. 5B being a plan view.

As shown in FIGS. 4A to 5B, each sliding rack of the automatic tablet packing apparatus includes a pair of left and right partition walls 53 and 54, the partition walls 53 and 54 being adapted to slide forward and rearward along upper and lower guide rails (not shown) provided in an upper region of a body of the apparatus. A tablet discharge passage 51 is defined between the pair of left and right partition walls 53 and 54. In the present embodiment, the pair of left and right partition walls 53 and 54 are not coupled to each other and thus, are able to individually slide forward and rearward along the guide rails. Cassette pedestals are detachably attached to outer surfaces of the left and right partition walls 53 and 54 and in turn, tablet cassettes C are mounted on the cassette pedestals.

Similar to the previously described conventional apparatus, the automatic tablet packing apparatus according to the embodiment of the present invention includes hoppers arranged in a lower region of the body and used to collect tablets discharged and dropped from the tablet cassettes C, a printer to print a variety of information on a surface of tablet packing paper, and a packing device to pack the collected tablets, having passed through the hoppers, by use of the packing paper.

The sliding rack, which is comprised of the pair of left and right partition walls 53 and 54, defines the tablet discharge passage 51 between the pair of left and right partition walls 53 and 54. Tablets discharged from the tablet cassettes based on a medical prescription are dropped from discharge holes 56 of the partition walls, the discharge holes 56 of the partition walls being in communication with tablet discharge holes (not shown) of the tablet cassettes C. Thereby, the tablets are packed by the packing device arranged in a lower region of the body.

A plurality of tablet cassettes C is detachably mounted on the cassette pedestals, which are also detachably attached to the outer surfaces of the left and right partition walls 53 and 54 defining the tablet discharge passage 51. Since the left partition wall 53 and the right partition wall 54 are able to slide individually, even if only the left partition wall 53 or the right partition wall 54 is pulled out of the automatic tablet packing apparatus, the interior of the tablet discharge passage 51 is directly revealed to the outside thus enabling a remarkably simplified cleaning operation of the tablet discharge passage 51.

Figure 6A:
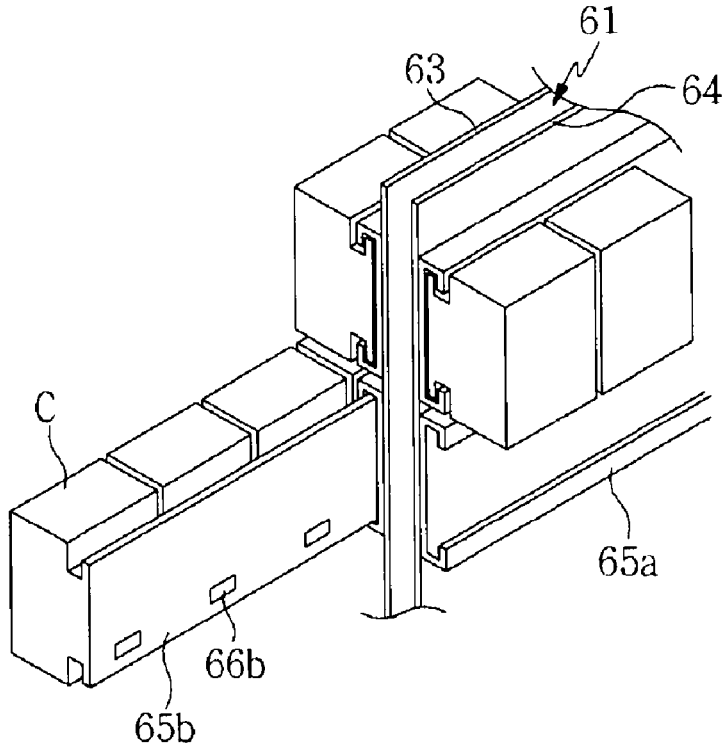
FIGS. 6A to 6C are, respectively, a perspective view and plan views illustrating an alternative embodiment of sliding racks provided in the automatic tablet packing apparatus according to the present invention.
Figure 6B:
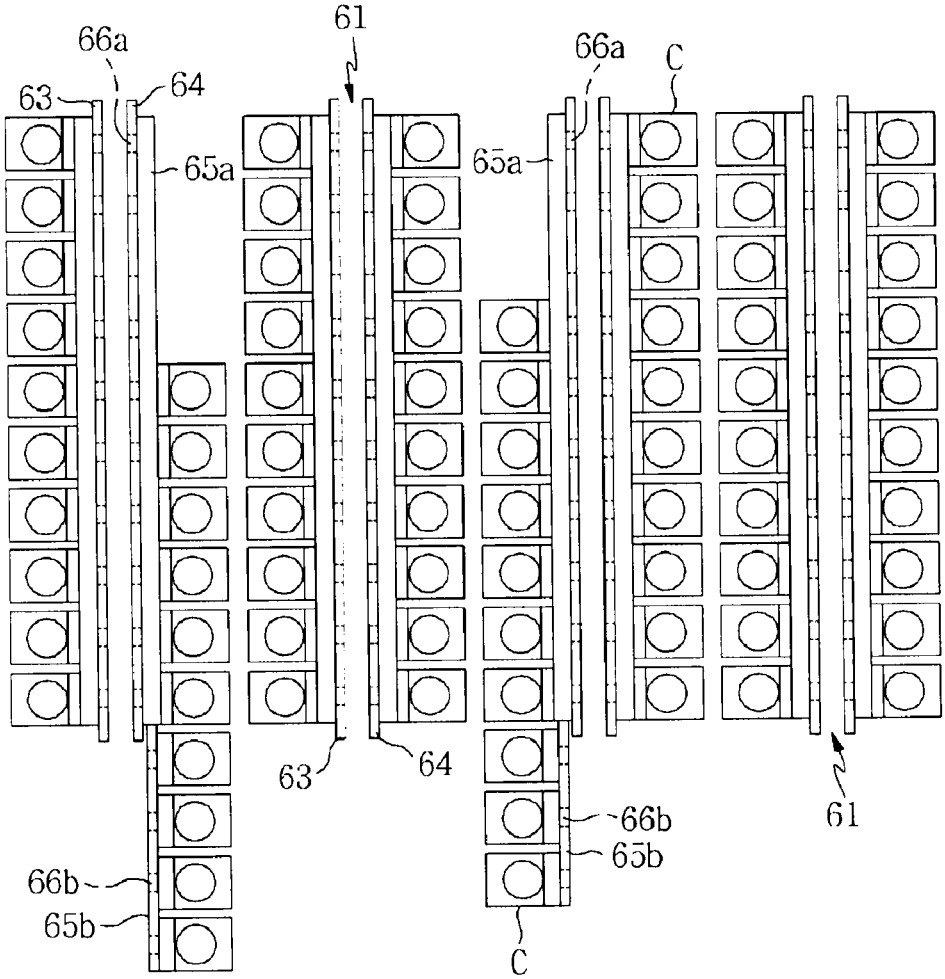
Figure 6C:
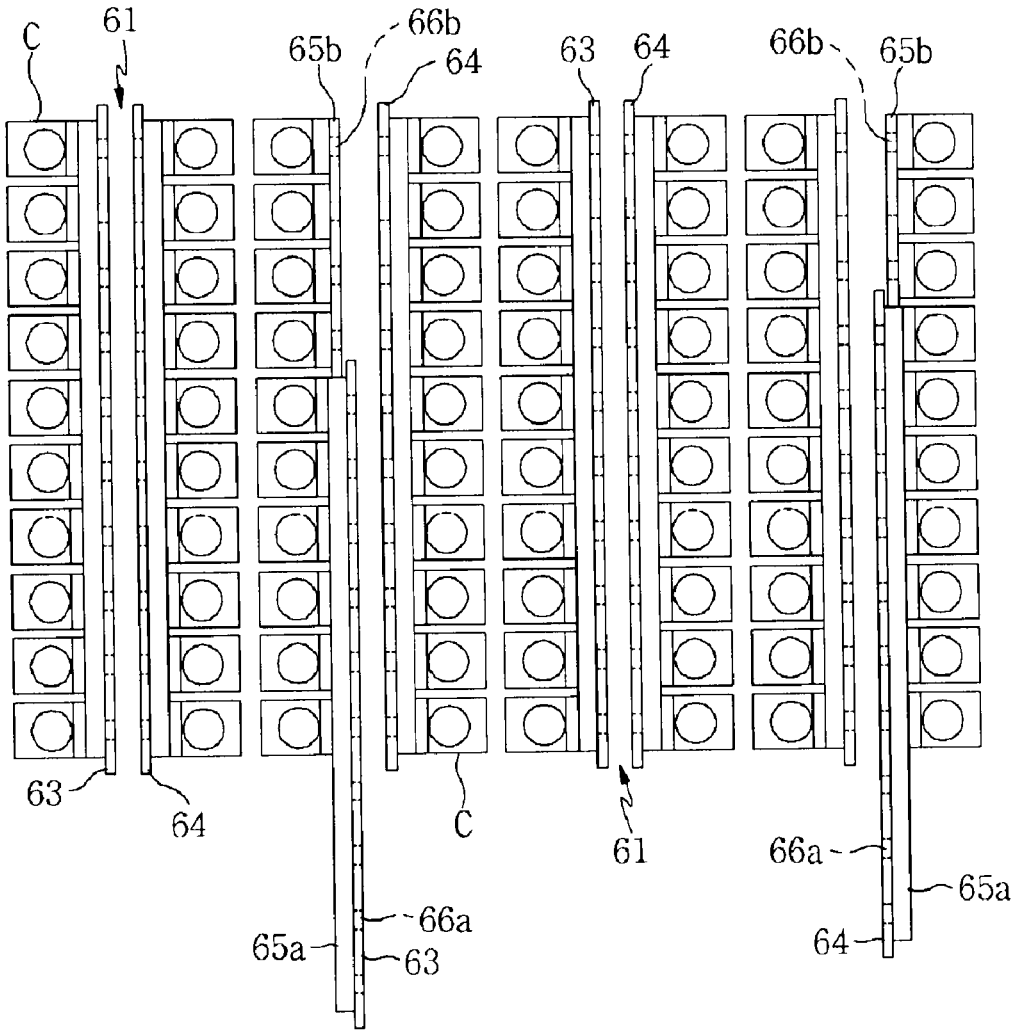

FIGS. 6A to 6C are, respectively, a perspective view and plan views illustrating a state wherein some of the tablet cassettes C are pulled out of the automatic tablet packing apparatus according to an alternative embodiment of the present invention. More particularly, FIGS. 6A to 6C illustrate an alternative configuration for mounting the tablet cassettes C to the pair of partition walls 63 and 64. As shown in FIG. 6A, cassette pedestals are attached to a cassette frame 65*b* in a transversal direction, and the tablet cassettes C are mounted on the cassette pedestals. A plurality of frame guides 65*a* are attached to outer surfaces of a pair of partition walls 63 and 64 in a transversal direction. Accordingly, the cassette frame 65*b* is able to slide along the corresponding frame guide 65*a*, so as to be detachably coupled to the outer surface of the left partition wall 63 or the right partition wall 64.

Although FIG. 6A illustrates the cassette pedestals and the tablet cassettes C as being separable on a per row basis, two or more rows of the cassette pedestals and the tablet cassettes C may be pulled out together if necessary. Of course, all the cassette pedestals and the tablet cassettes C installed to the left partition wall 63 or the right partition wall 64 may naturally be pulled out at once. For this, it is desirable that a single row of, or a plurality of rows of the tablet cassettes C be detachably attached to the cassette frame 65*b* and the cassette frame 65*b* be slidably installed to the frame guide 65*a* of the left or right partition wall 63 or 64 via bearings, etc. The frame guide 65*a* is attached to the outer surface of the left or right partition wall 63 or 64 and serves to guide forward and rearward movement of the cassette frame 65*b*.

On the other hand, as shown in FIG. 6C, the cassette frame 65*b*, to which the cassette pedestals and the tablet cassettes C are attached, may remain in the body of the automatic tablet packing apparatus, and only the left or right partition wall 63 or 64 defining a tablet discharge passage 61 may be individually pulled out of the body.

To prevent the cassette frame 65*b*, to which the cassette pedestals and the tablet cassettes C are attached, from being pulled out together with the left or right partition wall 63 or 64 when pulling out the left or right partition wall 63 or 64, it is desirable that a cassette grip tool (not shown) be provided at a body frame in order to selectively grip the cassette frame 65*b*, to which the cassette pedestals and the tablet cassettes C are attached, based on the user's selection.

The cassette frame 65*b* has frame discharge holes 66*b* for discharge of the tablets from the tablet cassettes C, and the left and right partition walls 63 and 64 have partition discharge holes 66*a* in communication with the frame discharge holes 66*b*. As the left partition wall 63 and right partition wall 64 defining the tablet discharge passage 61 are individually pulled out, the interior of the tablet discharge passage 61 is directly revealed to the outside thus enabling a remarkably simplified cleaning operation of the partition discharge holes 66*a*, from which the tablets of the respective tablet cassettes C are discharged.

Figure 7A:
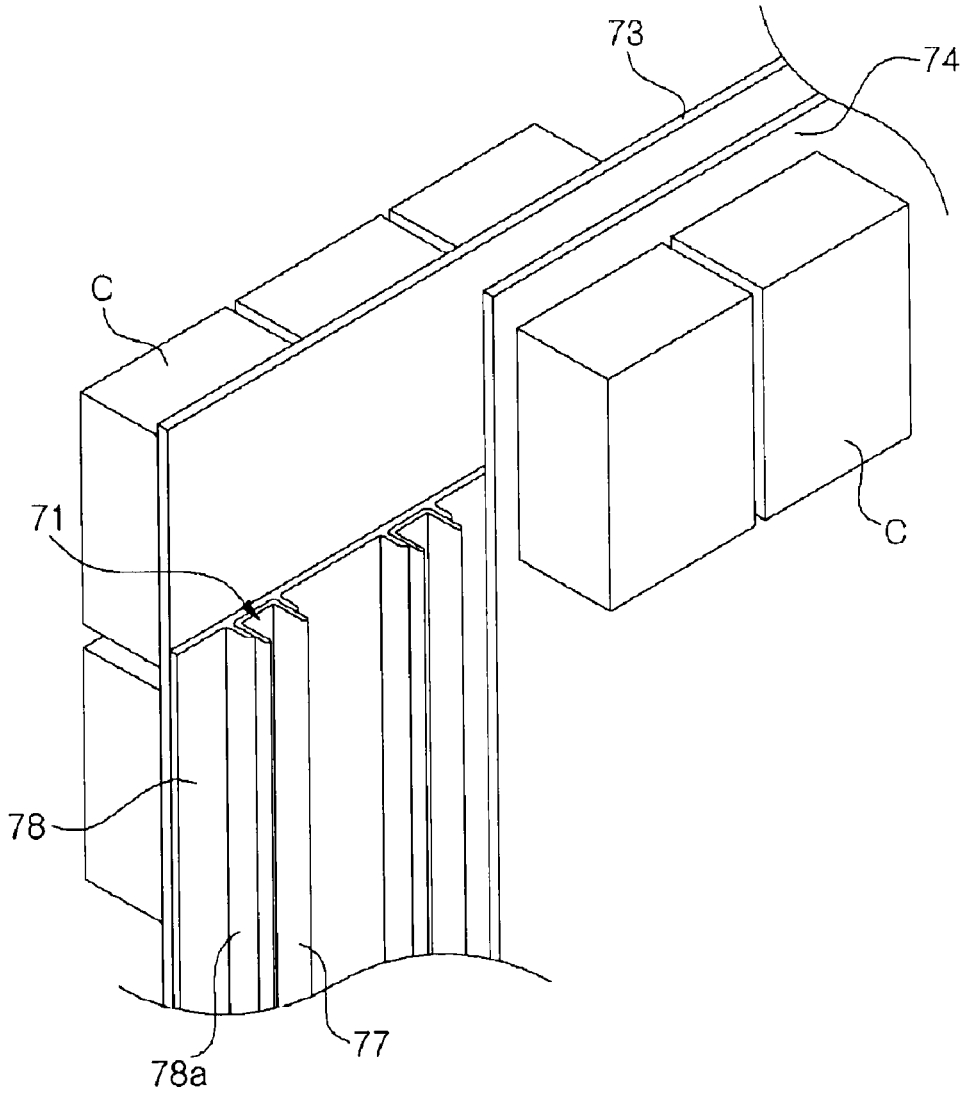
FIGS. 7A to 7C are, respectively, perspective views and a plan view illustrating another alternative embodiment of sliding racks provided in the automatic tablet packing apparatus according to the present invention.
Figure 7B:
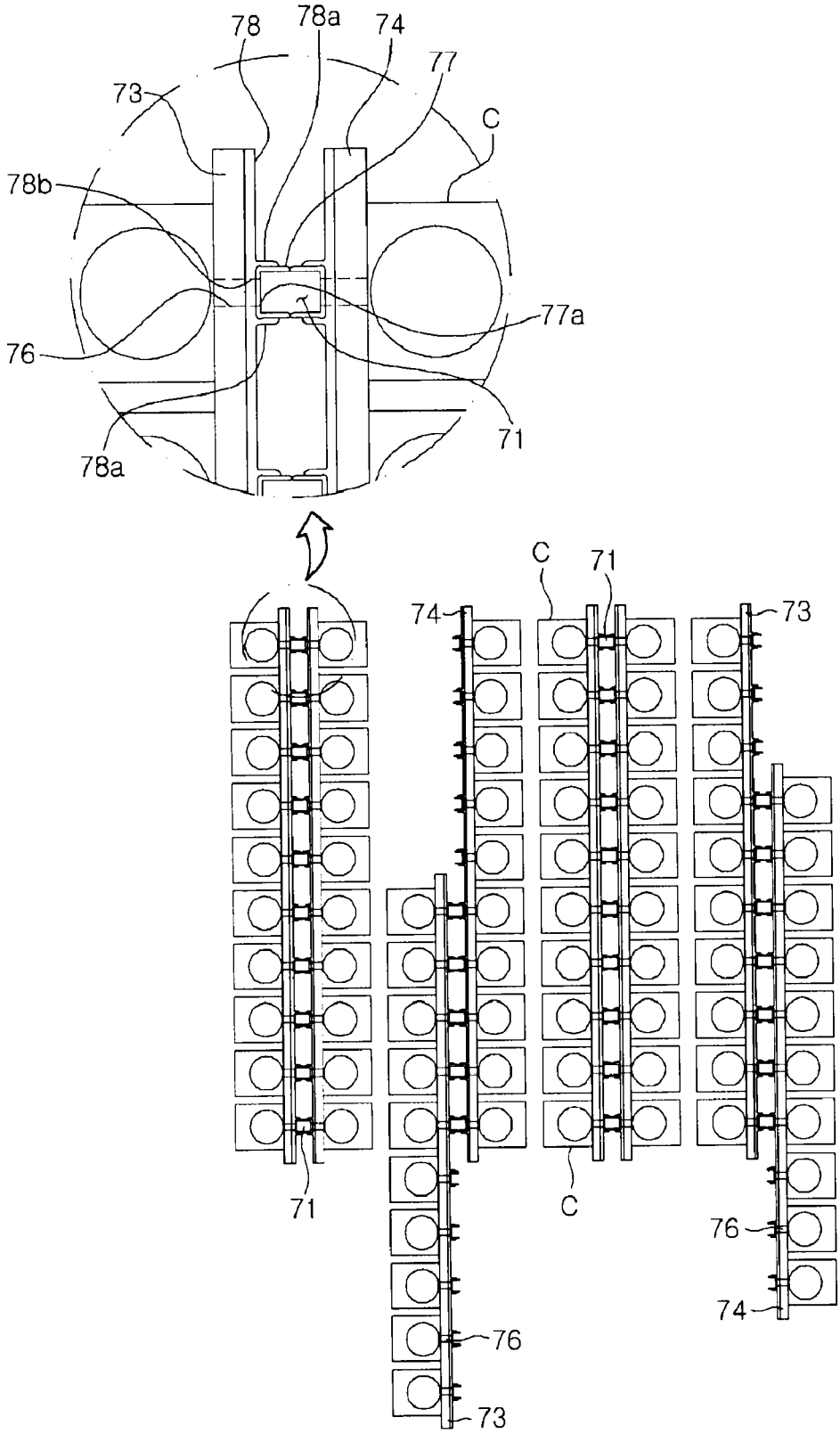
Figure 7C:
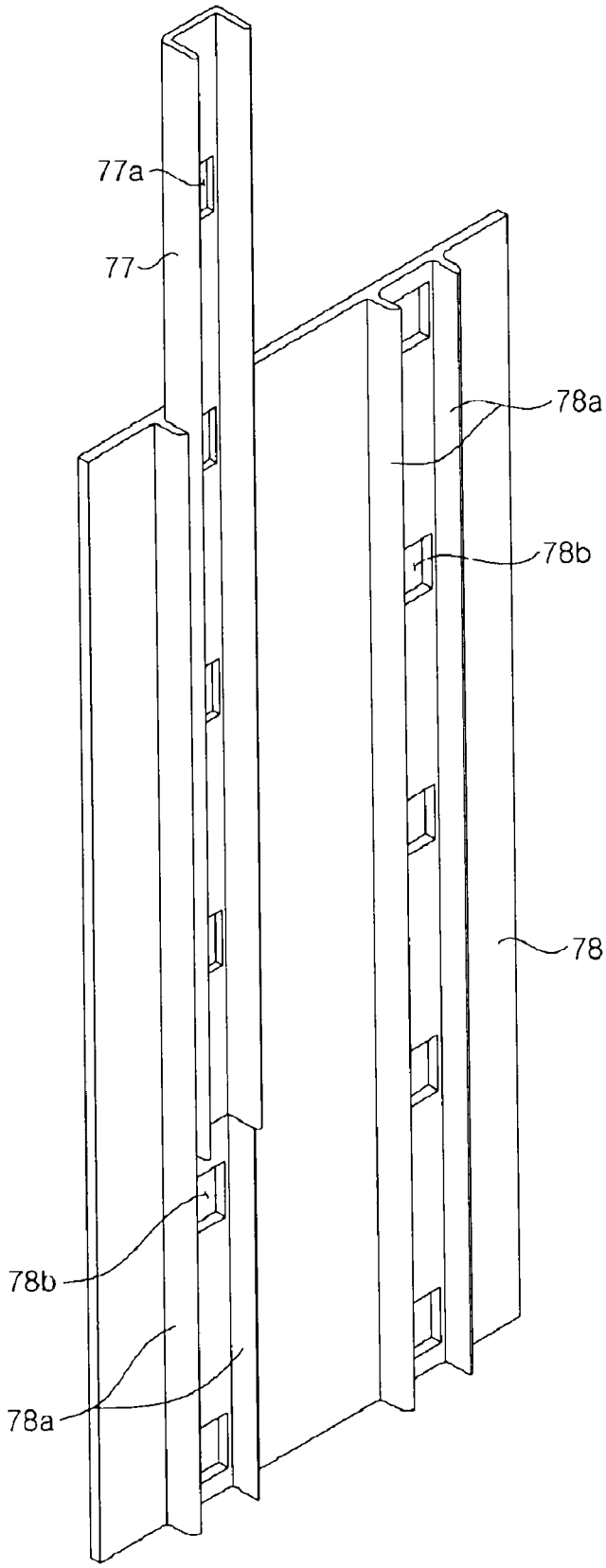

FIGS. 7A to 7C illustrate another alternative embodiment of the automatic tablet packing apparatus according to the present invention, wherein guide members, each of which is longitudinally formed with guide portions, are fixedly mounted to facing inner surfaces of left and right partition walls defining a tablet discharge passage.

As shown in FIGS. 7A to 7C, the cassette pedestals are attached to outer surfaces of left and right partition walls 73 and 74 defining a tablet discharge passage 71 and in turn, the tablet cassettes C are detachably mounted on the cassette pedestals. Guide members 78 are fixedly mounted to facing inner surfaces of the left and right partition walls 73 and 74 defining the tablet discharge passage 71, each guide member 78 being formed with guide portions 78*a*. The guide member 78 has through-holes 78*b* in communication with partition discharge holes 76. The through-holes 78*b* are aligned in a longitudinal direction of the guide member 78, and the guide portions 78*a* extend longitudinally at left and right sides of the through-holes 78*b*.

Channel members 77 are fitted between the neighboring guide portions 78*a*. The channel members 77 have discharge holes 77*a* in communication with the through-holes 78*b*. Accordingly, the guide members 78 and channel members 77 are respectively formed with the through-holes 78*b* and discharge holes 77*a* such that the size and position of these holes 78*b* and 77*a* correspond to those of the partition discharge holes 76 perforated in the left and right partition walls 73 and 74.

The channel members 77, detachably attached to the inner surfaces of the left and right partition walls 73 and 74, define tablet discharge passages 71, respectively. More specifically, the channel members 77 are attached to the inner surfaces of the left and right partition walls 73 and 74 so as to extend vertically, such that the tablets discharged from the tablet cassettes C of a vertical row can be discharged along the common tablet discharge passage 71.

Each of the channel members 77 has an approximately U-shaped cross section, and a combination of two channel members 77 arranged opposite each other define the rectangular or circular cross sectional tablet discharge passage 71.

Although FIG. 7C illustrates a plurality of guide portions 78*a* as protruding from each guiding member 78 to enable installation of the channel members 77, of course, it will be appreciated that the number of the channel members to be fitted to the guide member may be changed based on the designer's intention, and the embodiment of the present invention is not limited to the above-described configuration.

In the present embodiment, to allow the tablets discharged from the tablet cassettes C to drop along the tablet discharge passages 71, the guide members 78 and channel members 77 are perforated respectively with the through-holes 78*b* and discharge holes 77*a* such that the size and position of these holes 78*b* and 77*a* correspond to those of the partition discharge holes 76 perforated in the left and right partition walls 73 and 74.

With the above configuration, the channel members 77 defining the tablet discharge passages 71 may be separated individually from the guide portions 78*a* thus enabling more easy cleaning of the tablet discharge passages 71. Also, new channel members 77 may be fitted to the guide portions 78*a* if necessary.

As apparent from the above description, the present invention provides an automatic tablet packing apparatus, wherein left and right partition walls of each sliding rack are able to slide individually forward and rearward, whereby a tablet discharge passage defined by the left and right partition walls is revealed to the outside thus enabling more effective cleaning of the tablet discharge passage.

Further, according to the present invention, pulling out only the partition walls for the purpose of cleaning is possible. In an alternative configuration, each partition wall may be provided at an inner surface thereof with tablet discharge guide portions and channel members are able to be fitted to the guide portions. With this configuration, only the channel members may be pulled out to be cleaned, or may be replaced by new channel members, resulting in a more easy cleaning operation.

What is claimed is:

1. An automatic tablet packing apparatus having a sliding rack to be pulled out along upper and lower guide rails provided at an upper frame of a body, wherein the sliding rack includes a pair of left and right partition walls, a tablet discharge passage being defined between the pair of partition walls, wherein cassette pedestals are attached to outer surfaces of the left and right partition walls, and tablet cassettes are detachably arranged on the cassette pedestals, wherein the left and right partition walls are perforated with partition discharge holes in communication with tablet discharge holes of the tablet cassettes, wherein the left and right partition walls are separated from each other and are slidable individually along the guide rails, wherein a plurality of frame guides is provided at the outer surfaces of the left and right partition walls in a transversal direction, wherein a cassette frame is slidably coupled to each frame guide in a transversal direction, wherein a plurality of the cassette pedestals is attached to the cassette frame, and the tablet cassettes are mounted on the cassette pedestals, wherein the cassette frame has frame discharge holes in communication with the tablet discharge holes of the tablet cassettes, and wherein the frame discharge holes are also in communication with the partition discharge holes.

2. The apparatus according to claim 1, wherein the cassette frame is caught by a grip tool provided at a rear side of the body, to prevent the cassette frame from being pulled out together with the left or right partition wall when the left or right partition wall is pulled out.

3. The apparatus according to claim 1, wherein guide members are fixedly mounted, respectively, to the inner surfaces of the left and right partition walls.

4. The apparatus according to claim 3, wherein each of the guide members has through-holes in communication with the partition discharge holes, and wherein the through-holes are aligned in a longitudinal direction of the guide member, and guide portions protruding from the guide member extend longitudinally at left and right sides of the through-holes.

5. The apparatus according to claim 4, wherein a U-shaped channel member is fitted between the neighboring guide portions, and wherein the channel member has discharge holes in communication with the through-holes.

* * * * *